US007134904B2

(12) United States Patent
Bergner et al.

(10) Patent No.: US 7,134,904 B2
(45) Date of Patent: Nov. 14, 2006

(54) TERMINAL UNIT FOR PUTTING A LEAD INTO CONTACT WITH A PRINTED CIRCUIT BOARD

(75) Inventors: Bert Bergner, Benshelm (DE); Werner Boeck, Gross-Umstadt (DE); Guenter Feldmeier, Lorsch (DE); Franz Mueller, Grieshelm (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/986,980

(22) Filed: Nov. 12, 2004

(65) Prior Publication Data

US 2005/0124206 A1 Jun. 9, 2005

(30) Foreign Application Priority Data

Nov. 13, 2003 (EP) ..... 03025941

(51) Int. Cl.
*H01R 13/648* (2006.01)

(52) U.S. Cl. ..... 439/410; 439/676

(58) Field of Classification Search ..... 439/398, 439/409, 410, 630, 676, 862
See application file for complete search history.

(56) References Cited

U.S. PATENT DOCUMENTS 5,667,402 A 9/1997 Denovich et al.
5,762,518 A * 6/1998 Tanigawa et al. ..... 439/409
5,947,761 A * 9/1999 Pepe ..... 439/409
6,004,168 A * 12/1999 Fuchs et al. ..... 439/835
6,799,989 B1 * 10/2004 Doorhy et al. ..... 439/404
6,893,280 B1 * 5/2005 Thompson et al. ..... 439/276

FOREIGN PATENT DOCUMENTS

EP 0735613 B1 11/1999
EP 1 128 488 A2 8/2001
WO WO 98/34416 8/1998

* cited by examiner

*Primary Examiner*—Thanh-Tam Le
(74) *Attorney, Agent, or Firm*—Barley Snyder LLC

(57) ABSTRACT

A terminal unit with a housing and a cover is described, a cable receiving opening for a terminal module being provided in the cover. Contact members are arranged in the housing and held pivotably on the housing. The contact members have contacts which make electric contact with an electrical lead when the contact member is swivelled from an open position into a contact position. The contact members have seating surfaces which form a receiving chamber for a printed circuit board. The printed circuit board is part of the terminal module which can be slid into the aperture in the cover, conductors of the board making electric contact with the contacts of the contact members.

13 Claims, 8 Drawing Sheets

TERMINAL UNIT FOR PUTTING A LEAD INTO CONTACT WITH A PRINTED CIRCUIT BOARD

FIELD OF THE INVENTION

The invention relates to an electrical connector and more particularly to a terminal unit for putting a lead into contact with a printed circuit board.

BACKGROUND

A module with a network interface which makes an electric connection between a lead and a printed circuit board is known from WO 98/34416. In that reference, the module has a terminal member for the lead. The insulation displacement contact has a receiving chamber for the lead. In addition, the terminal member is mounted pivotably on the module. Insulation displacement contacts are further provided, into which the lead held in the terminal member is inserted when the terminal member is swivelled. The contact, in the form of an insulation displacement connecting device, is mounted stationary on the module. The insulation displacement connecting device is linked by electrical connections with a terminal contact of a plug socket into which the printed circuit board with corresponding contacts may be inserted. In this arrangement the lead moves on making contact with the contact, whereas the contact is immobile.

An electrical connector whereby leads can be connected to a connector is known from EP 0 735 613 B1. In that reference, the leads are inserted in a retainer which is then slipped onto a retaining module. The retaining module has a swivelling lever which presses the retainer against insulation displacement terminals when pressed down, so that electrical contact is made between the leads and those terminals. The insulation displacement terminals are mounted stationary on the retaining module. They are electrically connected to contacts of the connector.

SUMMARY

A terminal unit for putting an electrical lead in contact with a printed circuit board, features a housing, a contact member and a contact. The housing includes a retaining cage for the electrical lead. The contact member is held movably on the housing, such that the contact member can be moved from an open position to a contact position. The contact member also has a receiving chamber to receive the printed circuit board. The contact for contacting the electrical lead is held in the contact member. The contact is electrically contacted with the electrical lead and is guided into the receiving chamber for electric contacting with a conductor of the printed circuit board.

BRIEF DESCRIPTION OF THE DRAWINGS

The invention will be explained more specifically below with reference to the accompanying drawings, in which.

DETAILED DESCRIPTION OF THE PREFERRED EMBODIMENT(S)

Figure 1:
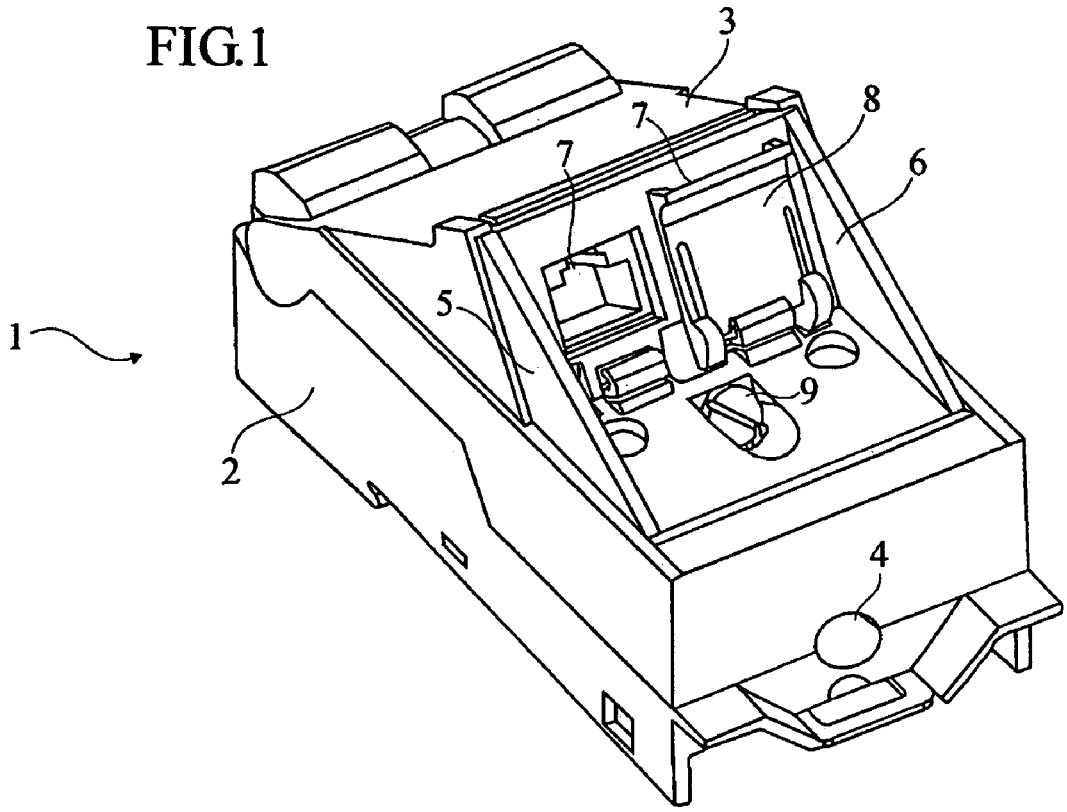
FIG. 1 is a perspective view of the terminal unit.

The invention will now be described in greater detail. FIG. 1 shows a terminal unit 1 with a housing 2 and a cover 3. Between the housing 2 and the cover 3 there is a cable receiving opening 4 for feeding in a cable. A module receiving aperture 5 with a terminal module 6 inserted in it is provided in the cover 3. Two sockets 7 are provided in the terminal module 6, the right-hand socket 7 being covered for example with a hinged cover 8. The terminal module 6 is fixed in the cover 3 by a screw 9. The screw 9 is in the form of a lifting screw which may be used to displace the terminal module 6 and release that module. The terminal module 6 may be moved from a pre-latching position to a contact position by means of the screw 9.

Figure 2:
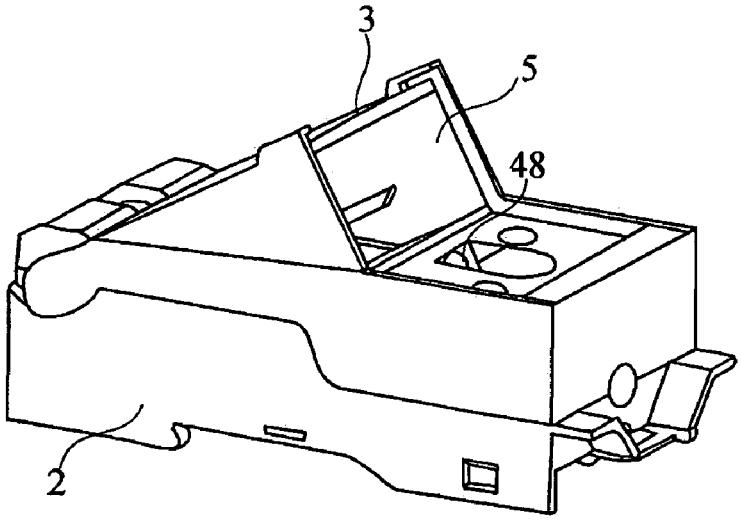
FIG. 2 is a perspective view of the terminal unit without the terminal module.

FIG. 2 shows the terminal unit 1 before the terminal module 6 is inserted in the module receiving aperture 5. The cover 3 has screw thread 48 for screwing the module 6 onto the cover 3.

Figure 3:
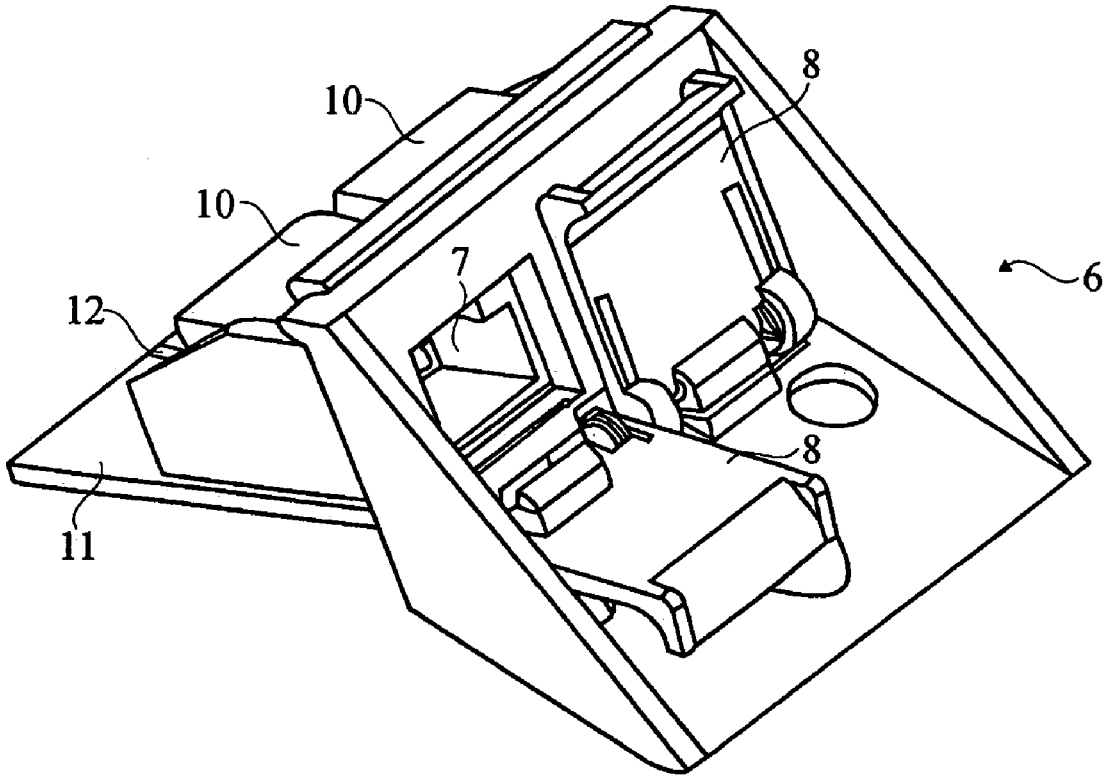
FIG. 3 is a larger-scale view of the terminal module.

FIG. 3 shows the terminal module 6, which has a socket housing 10 and a printed circuit board 11. The printed circuit board 11 has conductors 12 which are electrically connected to contacts of the sockets 7 and arranged on the underside of the printed circuit board 11. The sockets 7 are designed for example for connectors of telephone cables or connectors of network cables.

Figure 4:
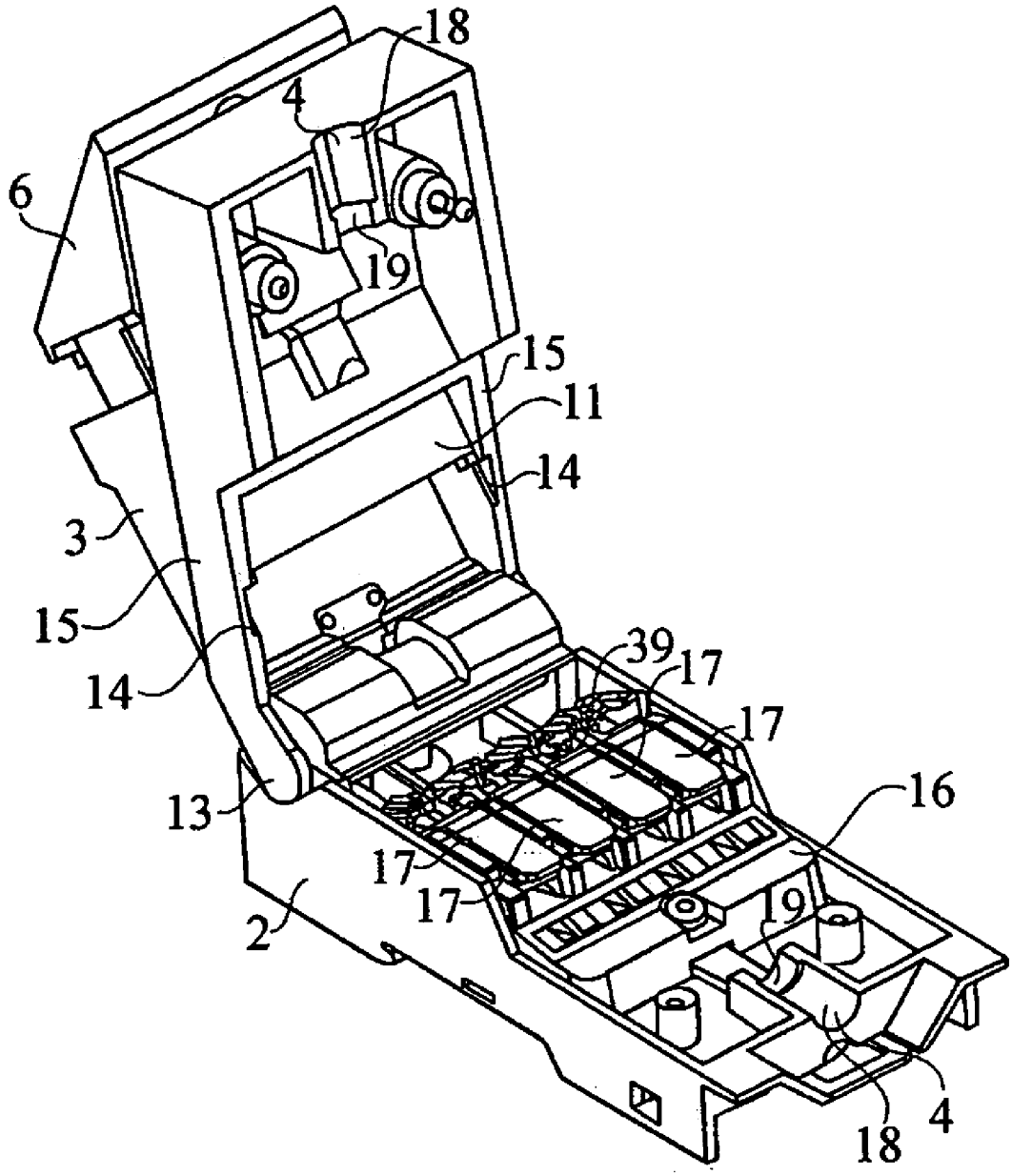
FIG. 4 shows the terminal unit with the cover swung open.

FIG. 4 shows the terminal unit 1 with a cover 3 swung open. In the embodiment illustrated, the cover 3 is supported on the housing 2 so that it can be swivelled by means of a hinge 13. The terminal module 6 is pre-mounted in the cover 3 and not fully inserted in the module receiving aperture 5. The printed circuit board 11 is guided laterally in slots 14 in side walls 15 of the cover 3. A contact retainer 16 is arranged in the housing 2 and secured to a base of the housing 2 by a suitable fastener such as a screw. A plurality of contact members 17 are arranged on the contact retainer 16. The cable receiving opening 4 is bounded partly by the housing 2 and partly by the cover 3. A strain relief section 18 and a shield contact section 19 are arranged in the cable receiving opening 4. The function of the strain relief section 18 is to clamp an insulating jacket of the cable. The shield contact section 19 is produced from an electrically conductive material and its function is to make electrical contact with a shield of a cable. The housing 2 and cover 3 are preferably produced from an electrically conductive material, particularly a die-cast material, so shielding against electromagnetic radiation is achieved. The contact retainer 16 is preferably made of an insulative material or a material which shields against electromagnetic radiation.

Figure 5:
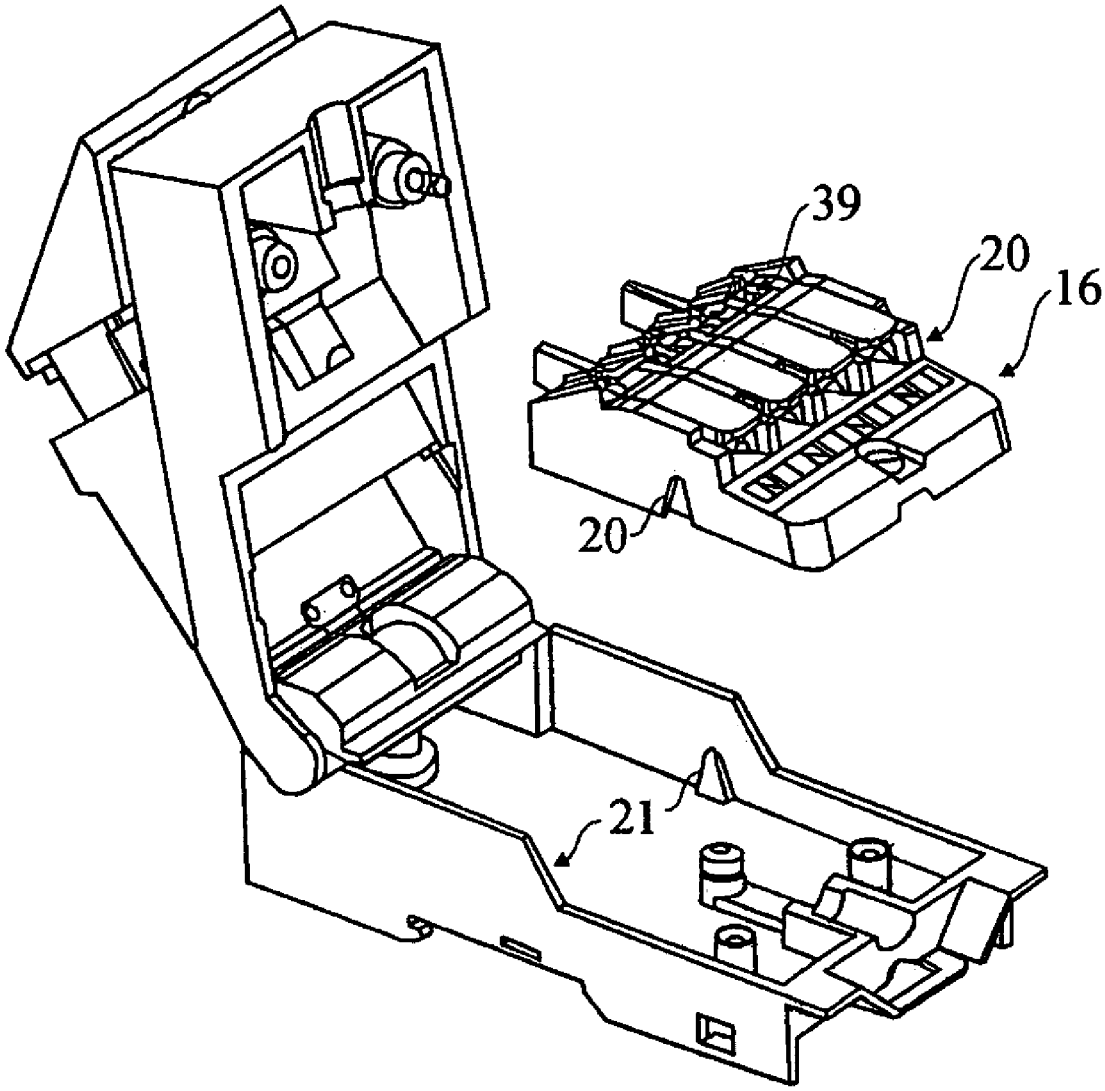
FIG. 5 shows the terminal unit with the cover swung open and with the carrier plate before assembly.

FIG. 5 shows the terminal unit 1 swung open with the contact retainer 16 before being mounted in the housing 2. In a preferred embodiment the contact retainer 16 is supported in the housing 2 by a compensating mounting so that manufacturing tolerances can be compensated. In the example illustrated, the compensating mounting is shown in the form of wedge-shaped recesses 20 and wedge-shaped segments 21, the recesses 20 being formed in side walls of the contact retainer 16 and the segments 21 in side walls of the housing 2. The compensating mounting is advantageous because the printed circuit board 11 is slid in the assembled state into a receiving chamber 39 formed by the contact members 17. The compensating mounting therefore enables manufacturing tolerances to be compensated. Accurate alignment of the contact members 17 with the printed circuit board 11 is necessary in order to make good contact with the printed circuit board 11. The compensating mounting enables the contact retainer 16 to be both tilted and displaced in the longitudinal direction. The tilting axis is defined by the seating surface of the wedge-shaped segments 21 on which the contact retainer 16 rests in the wedge-shaped recesses 20.

Figure 6:
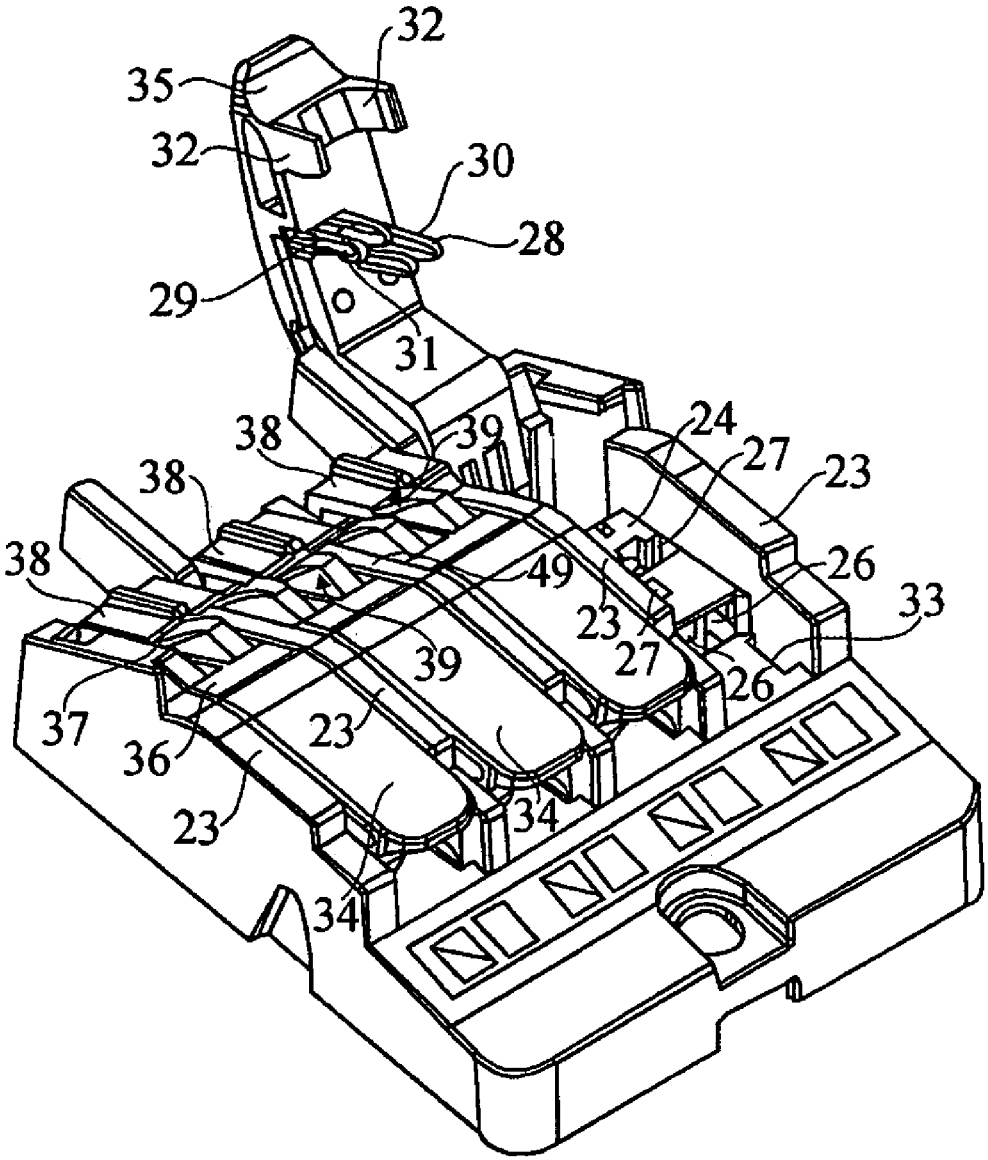
FIG. 6 shows the carrier plate with one contact member swung open.

FIG. 6 shows the contact retainer 16 with four contact members 17, the right-hand contact member 17 being in an open position. The four contact members 17 are juxtaposed, and in this special embodiment, each contact member 17 is held on the contact retainer 16 so that it can swivel by means of a hinge pin. In a simple embodiment the contact retainer 16 may also be integral with the housing 2. Partition walls 23 are arranged between the contact members 17 and, preferably with the contact retainer 16, are made of a material which shields against electromagnetic radiation. A retaining cage 24 for receiving and holding electrical leads 25 is in each case arranged between the partition walls 23. In the embodiment illustrated, two juxtaposed and separated channels 26 are provided in the retaining cage 24. The retaining cage 24 is made of an insulative material. The channels 26 are open at the front. Two contact apertures 27 are formed at the top of the retaining cage 24. The contact apertures 27 of the two channels 26 are offset from each other in the longitudinal direction of the channels 26. At least the top of the retaining cage 24 is preferably made of a transparent material. Each channel 26 has a stop face opposite the front of the channels 26. For correct assembly the electrical leads 25 are inserted into the front of the conductor channels 26 as far as the stop face.

In the embodiment illustrated the contact member 17 has two contacts 28, 29. In this embodiment the two contacts 28, 29 have contact regions 30, 31 in the form of insulation displacement connecting devices arranged perpendicular to the underside of the contact member 17. The contact regions 30, 31 are arranged in such a way that when the contact member 17 is swivelled the first and second contact areas 30, 31 engage in the associated contact aperture 27, establishing an electrical connection with the electrical leads 25 inserted in the channels 26. The contact member 17 is produced from an insulative material into which the contacts 28, 29 are inserted.

The contact member 17 extends in the longitudinal direction to beyond the retaining cage 24 in the direction of the electrical leads 25. In the front end region the contact member 17 has two brackets 32 arranged opposite each other on longitudinal sides of the member 17. The function of the brackets 32 is to hold the two leads 25 laterally and preferably press them together. Brackets 32 are long enough for their ends to engage in associated apertures 33 in the contact retainer 16 when the contact member 17 is in the contact position. The brackets 32 have a diameter which widens from the ends to the center of the contact member 17, so that an upwardly tapering surface is formed in cross-section by the two brackets 32. In a preferred embodiment the brackets 32 each have a latching lug on the inside, which engage in corresponding latching recesses in the apertures 33. In this way the contact members 17 are held securely in the contact position, i.e. in the latched condition.

The contact members 17 have an actuating surface 34 at the top and a gripping surface 35 at the front end towards the electrical leads 25. The contact member 17 can easily be pushed from the open position to the contact position by an operator by means of the actuating surface 34. The force required to contact the electrical leads 25 can easily be applied by means of the relatively large actuating surface 34. If insulation displacement connecting devices are used the insulation of the leads 25 has to be undone. The contact member 17 can be opened from the contact position in a simple manner by means of the gripping surface 35, which can be actuated with a tool or a finger.

The contact members 17 have first seating surfaces 36 and second seating surfaces 37 at the end opposite the gripping surface 35. The first seating surface 36 is arranged on the top of the contact member 17. The second seating surface 37 is located on the inside of a U-shaped end piece 38 of the contact member. The first and second seating surfaces 36, 37 bound a receiving chamber 39. The first and second seating surfaces 36, 37 of the four contact members 17 are arranged parallel with each other and bound the receiving chamber 39 for receiving an edge region of the printed circuit board 11. The partition walls 23 are preferably bevelled in the region of the receiving chamber 39 to match the inclination of the first seating surfaces 36, and the bevelled surface 49 of the partition walls 23 forms a further seating surface for the printed circuit board 11.

Figure 7:
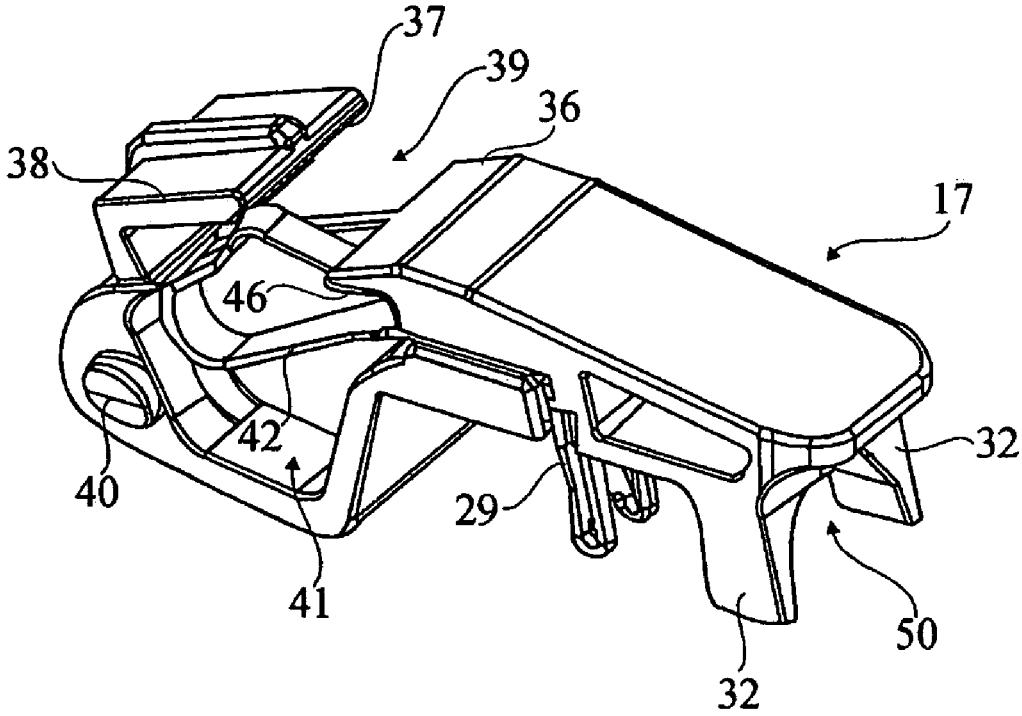
FIG. 7 shows a contact member with contact.

FIG. 7 is a perspective view of a contact member 17 with a second contact 29 in the form of a spring contact. The upwardly tapering surface 50 between the two brackets 32 is also clearly recognisable in FIG. 7. It is formed between the brackets 32 and is preferably responsible for clamped retention of the leads 25. The contact member 17 has an S shape in the rear region and is bent down under the receiving chamber 39 forming a space 41. The contact member 17 has a second hinge pin 40, about which the contact member 17 is supported pivotably with the contact retainer 16. The space 41 into which a U-shaped contact piece 42 of the second contact 29 can pass resiliently when the printed circuit board 11 is inserted is formed under the receiving chamber 39.

Figure 8:
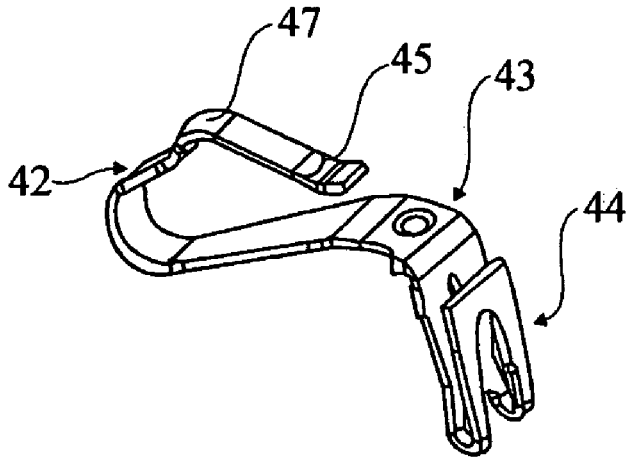
FIG. 8 shows a contact in the form of a spring contact.

FIG. 8 shows an embodiment of the first and second contacts 28, 29 in the form of a spring contact 43, in a perspective view. In a front end region the spring contact 43 has an insulation displacement connecting device 44 for making electrical contact with the electrical lead 25. In the rear end region the spring contact 43 is in the form of a U-shaped contact piece 42, and a second end piece 45 engages under a seating surface 46 of the contact member 17. The contact piece 42 is thereby pre-tensioned. It has an upwardly curved contact surface 47, provided to make electrical contact with a contact member 17 of the printed circuit board 11. The U shape of the contact piece 42 gives high resilience despite the compact shape of the spring contact 43, so secure electric contact is obtained between the contact surface 47 and a conductor 12 of the printed circuit board 11.

Figure 9:
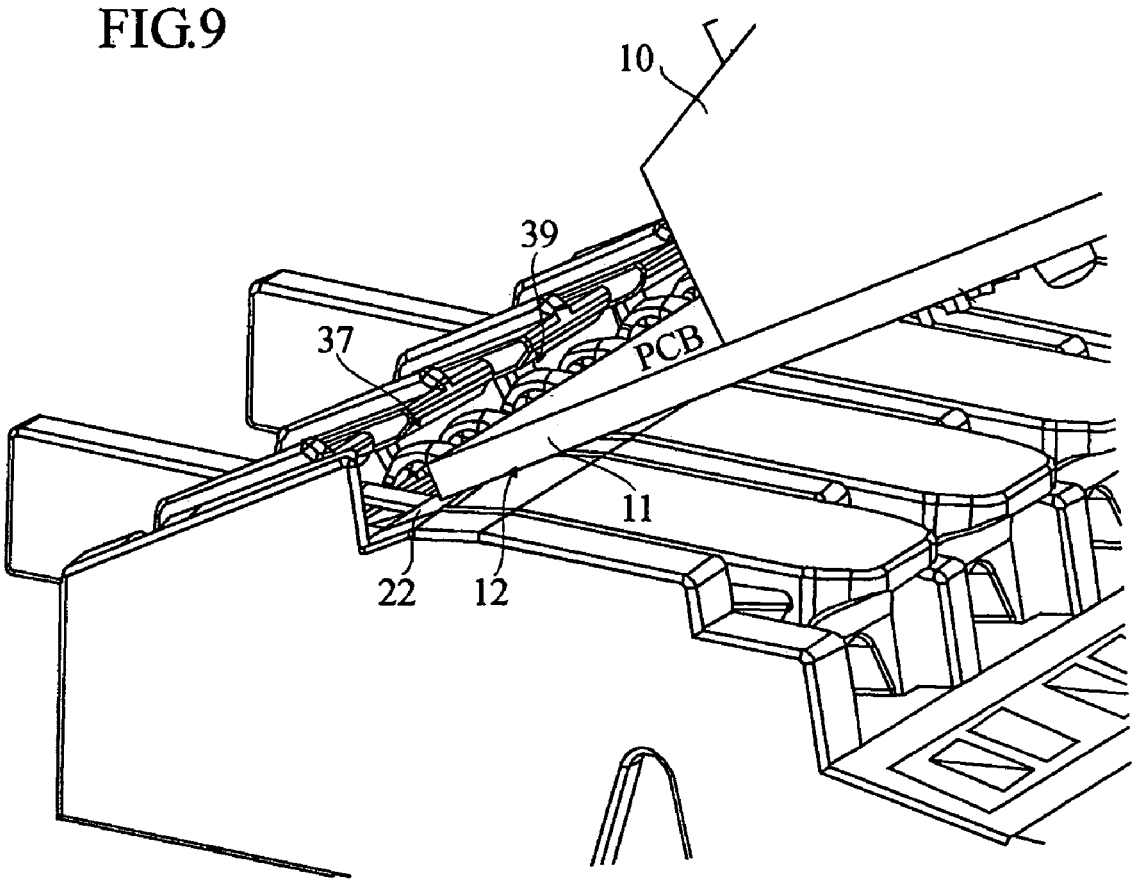
FIG. 9 shows a fragment of a terminal unit with the printed circuit board being inserted into it.
Figure 10:
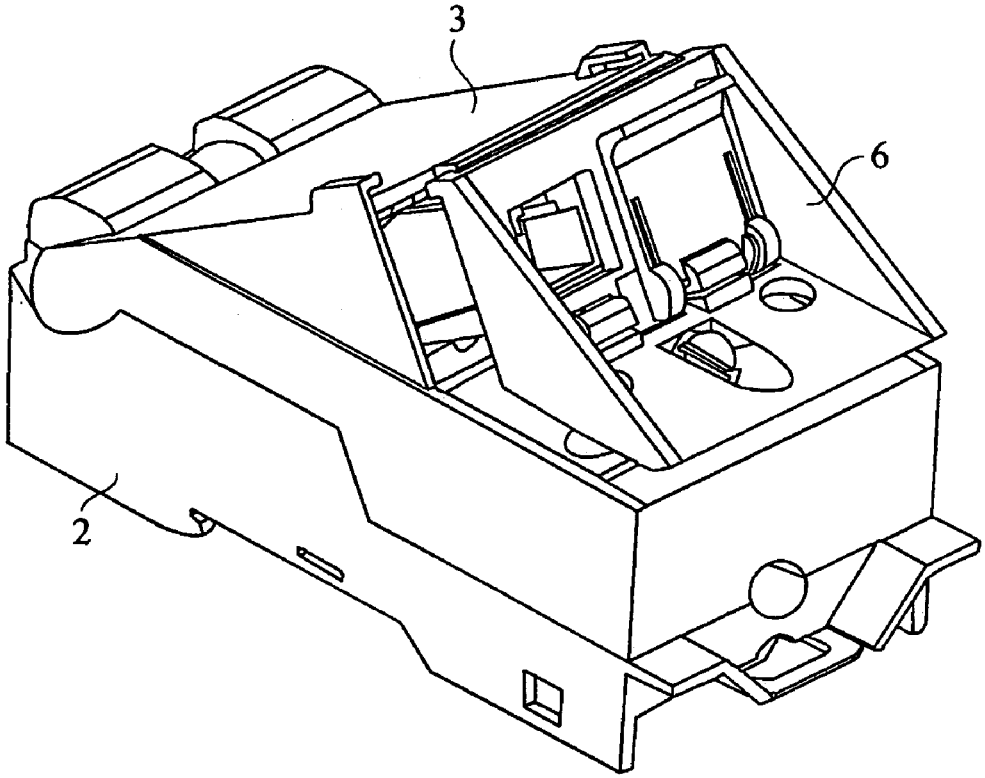
FIG. 10 shows the terminal unit with the terminal module in a pre-assembly position.
Figure 11:
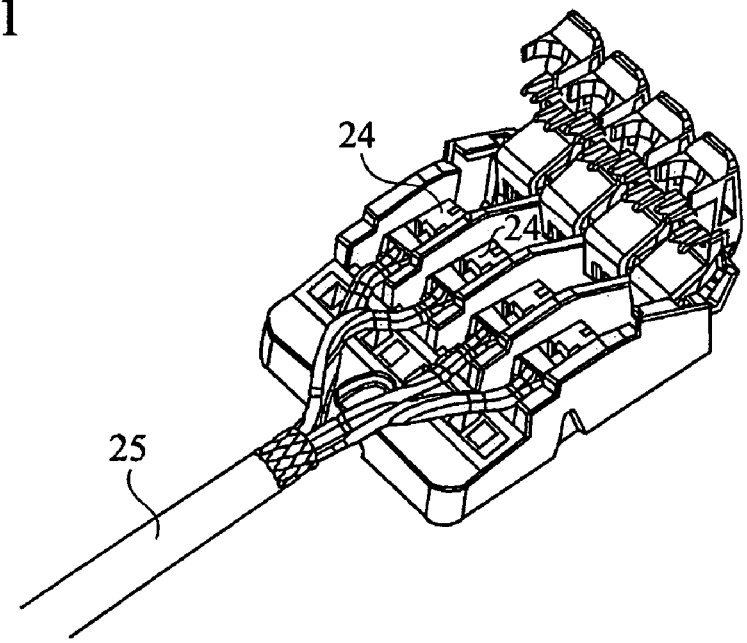
FIG. 11 shows a terminal module with a cable.

FIG. 9 shows an enlarged fragment of a terminal unit 1 with the terminal module 6 in the pre-mounted condition as illustrated in FIG. 10. In this position the receiving chamber 39 bounded by the first and second seating surfaces 36, 37 is arranged parallel with the alignment of the printed circuit board 11. If the terminal module 6 is now pushed deeper into the cable receiving opening 4, an end piece 22 of the printed circuit board 11 slides into the receiving chamber 39 and electric contact is made between the contacts 28, 29 of the contact members 17 and the conductors 12 of the printed circuit board 11. The conductors 12 are located on the underside of the printed circuit board 11. The printed circuit board 11 is pressed against the second seating surface 37 by the spring tension of the contacts 28, 29. Thus the printed circuit board is held directly in the contact members 17. An end piece of the contact is further arranged in the receiving region. In addition a gap in the contact member 17 is provided in the receiving region, into which gap the end piece 22 can pass resiliently when the board is being mounted. The end piece of the contact is preferably in the form of a U-shaped end, thereby giving the contact great resilience.

One advantage of the terminal unit is that the contact member with the contact is mounted movably on the housing and moved into a contact position on contacting the lead. In this way the lead can be mounted rigidly on the housing of the terminal unit and movement of the lead is not necessary. Simple mounting of the lead is therefore sufficient.

For simple operation of the contact member an actuating surface is advantageously provided on the top of that member. The actuating surface enables an operator to move the contact member into the contact position in a simple movement and without exerting great effort. This is advantageous particularly when the lead has electric insulation and the contact is in the form of an insulation displacement connecting device which has to sever the electric insulation of the lead in order to make contact.

Two contacts are provided in a contact member, arranged offset from each other in the direction of the leads. In this way adequate clearance is provided between the two contacts although the leads are closely juxtaposed.

A plurality of contact members are juxtaposed in the housing and partition walls are provided between them. The partition walls are preferably made of a material which shields electromagnetic radiation advantageously reducing interaction between the signals flowing through the leads.

The retaining means has a front aperture for guiding in the lead and a top aperture for guiding in the contact. Furthermore the retaining means is preferably made of a transparent material at least at the top. When the lead is being mounted the transparent material makes it possible to check whether the leads are pushed into the correct place.

The pivotable mounting advantageously enables the cover to be moved into an assembly position in which free access to the contact members is possible. When the leads have been assembled and the contact members put into contact with them the cover is moved into an inserting position for the printed circuit board, in which the board can be slid directly into the insertion region of the contact members.

What is claimed is:

1. A terminal unit for putting an electrical lead in contact with a printed circuit board, comprising:

a housing with a retaining cage for receiving an electrical lead;

a contact member being held movably on the housing, such that the contact member can be swiveled from an open position to a contact position, the contact member having a receiving chamber to receive the printed circuit board;

a contact for contacting the electrical lead, the contact being held in the contact member, the contact being electrically contacted with the electrical lead, and the contact being guided into the receiving chamber for electrical contacting with a conductor of the printed circuit board; and, the receiving chamber is formed by two seating surfaces of the contact member and an end piece of the contact member is arranged in the receiving chamber, and a space adjoining the receiving chamber is formed in the contact member into which a contact piece of the contact recedes when an end piece of the printed circuit board is introduced therein.

2. The terminal unit according to claim 1, further comprising a contact retainer which holds the contact member, the contact retainer is mounted to the housing by a compensating mounting which enables a tilting movement of the contact retainer and/or a displacement of the contact retainer.

3. The terminal unit according to claim 2, wherein the contact member is held so that it can swivel about a hinge, such that the contact can be swivelled into the retaining cage for contacting with the electrical lead.

4. The terminal unit according to claim 2, further comprising two laterally arranged brackets arranged on the contact member, the brackets being receivable by two apertures in the contact retainer when in the contact position.

5. The terminal unit according to claim 3, wherein the contact member has an actuating surface on top, provided for swivelling the contact member.

6. The terminal unit according to claim 5, wherein two contacts are arranged in the contact member, the two contacts have contact regions with which electrical contact is made with associated electrical leads.

7. The terminal unit according to claim 6, wherein the contact regions are arranged offset from each other in the longitudinal direction of the electrical leads.

8. The terminal unit according to claim 3, wherein a plurality of contact members are juxtaposed in the housing, partition walls are arranged between the contact members, and the partition walls are produced from a material which shields electromagnetic radiation.

9. The terminal unit according to claim 6, wherein the retaining cage comprises a front aperture for guiding the electrical lead, and a contact aperture for guiding in the contact.

10. The terminal unit according to claim 9, wherein the retaining cage is made of a transparent material at least at a top thereof.

11. A terminal unit for putting an electrical lead in contact with a printed circuit board, comprising:

a housing with a retaining case for receiving an electrical lead;

a contact member being held movably on the housing, such that the contact member can be moved from an open position to a contact position, the contact member having a receiving chamber to receive the printed circuit board;

a contact for contacting the electrical lead, the contact being held in the contact member, the contact being electrically contacted with the electrical lead, and the contact being guided into the receiving chamber for electrical contacting with a conductor of the printed circuit board; and, the housing having a cover, a module receiving aperture for the printed circuit board and a socket are provided in the cover, the printed circuit board is held displaceably by slots in the cover, and the printed circuit board can be inserted in the receiving chamber of the contact member.

12. The terminal unit according to claim 11, wherein the printed circuit board is aligned with the receiving chamber when the cover is swivelled into the contact position.

13. The terminal unit according to claim 12, wherein the printed circuit board is held displaceably to the cover, the printed circuit board is in a standby position in the open position of the cover, and the printed circuit board can be moved into the contact position wherein the printed circuit board is slid into the receiving chamber, and electric contact is made between the printed circuit board and the contact member.

* * * * *